United States Patent [19]

Barry et al.

[11] Patent Number: 4,906,354

[45] Date of Patent: Mar. 6, 1990

[54] PROCESS FOR IMPROVING THE THERMAL STABILITY OF JET FUELS SWEETENED BY OXIDATION

[75] Inventors: Edward G. Barry, Woodbury; Joseph G. Bendoraitis, Pitman, both of N.J.; Perry W. Kirklin, Southampton, Pa.; David A. Pappal, Sewell, N.J.

[73] Assignee: Mobil Oil Corporation, New York, N.Y.

[21] Appl. No.: 95,488

[22] Filed: Sep. 10, 1987

[51] Int. Cl.[4] ..... C10G 19/00

[52] U.S. Cl. ..... 208/189; 208/192; 208/197; 208/201; 208/203; 208/206

[58] Field of Search ..... 208/189, 192, 197, 203, 208/193, 201, 206

[56] References Cited

U.S. PATENT DOCUMENTS

| | | | |
|---|---|---|---|
| 2,082,787 | 6/1937 | Birch | 208/201 |
| 2,515,141 | 7/1950 | Borden | 208/201 |
| 2,724,684 | 11/1955 | Sweetser et al. | 208/203 |
| 2,740,747 | 4/1956 | Sweetser et al. | 208/189 |
| 2,882,224 | 4/1959 | Gleim et al. | 208/206 |
| 2,966,453 | 12/1960 | Gleim et al. | 208/189 |
| 2,988,500 | 6/1961 | Gleim et al. | 208/203 |
| 3,141,842 | 7/1964 | Wallace et al. | 208/189 |
| 3,260,665 | 7/1966 | Urban | 208/206 |
| 4,675,100 | 6/1987 | Maple et al. | 208/189 |

FOREIGN PATENT DOCUMENTS

| | | | |
|---|---|---|---|
| 565985 | 11/1958 | Canada | 208/189 |
| 752361 | 2/1967 | Canada | 208/203 |
| 0921549 | 3/1963 | United Kingdom . | |

OTHER PUBLICATIONS

*Modern Petroleum Technology,* G. D. Hobson, ed., Applied Science Publishers, Ltd. on behalf of the Institute of Petroleum, pp. 392–396.

*Petroleum Processing Handbood,* Wm. F. Bland and R. L. Davidson, eds., New York: McGraw-Hill, pp. 3–128 and 3–129.

Kirk-Othmer, *Encyclopedia of Chemical Technology,* 3d Ed., vol. 17, pp. 227 and 229, (New York: John Wiley & Sons).

Verachtert, T. A. et al., "Merox Treatment of Kerosine", 1981 UOP Process Division Technology Conference, Sep.-Nov., 1982.

*Primary Examiner*—Helane Myers

*Attorney, Agent, or Firm*—Alexander J. McKillop; Charles J. Speciale; Malcolm D. Keen

[57] ABSTRACT

The thermal stability of jet fuel sweetened by oxidation is improved by washing the sweetened fuel with strong aqueous caustic.

5 Claims, 1 Drawing Sheet

PROCESS FOR IMPROVING THE THERMAL STABILITY OF JET FUELS SWEETENED BY OXIDATION

BACKGROUND OF THE INVENTION

1. Field of the Invention

This invention relates to a process for improving the thermal stability of jet fuels which have been sweetened by oxidation, for example, by the Bender and Merox processes.

There are very stringent specifications for kerosines used as jet or aviation turbine fuels. In addition to having the correct hydrocarbon composition, the kerosine must contain less than 0.003% by weight of mercaptan and exhibit satisfactory thermal stability.

Higher boiling hydrocarbon fractions, particularly kerosine and jet fuels, are generally sweetened by oxidation using a variation of the Bender or Merox process. A fixed bed Merox process is most commonly employed. The term fixed bed refers to the fact that the catalyst for the Merox process is impregnated or fixed onto a bed of catalyst support material, such as activated charcoal. The catalyst, in the presence of alkali and oxygen, promotes the oxidation of mercaptans present in the fuel to disulfides according to the equation:

$$4RSH+O_2 \rightarrow 2RSSR+H_2O$$

A similar reaction occurs in other processes where sweetening is effected by oxidation. The term sweetening refers to the conversion of mercaptans to disulfides and the elimination of the offensive mercaptan odor. The disulfides are oil-soluble and remain dissolved in the jet fuel.

Certain distillates, after conventional sweetening by oxidation, and even after further purification by treatment with clay, fail the Jet Fuel Thermal Oxidation Tester (hereinafter JFTOT test) and are unsuitable for use as jet fuels.

SUMMARY OF THE INVENTION

We have discovered that the thermal stability of jet fuel sweetened by an oxidation process can be improved by washing the sweetened fuel with caustic. More specifically, the present invention is a method for improving the thermal stability of jet fuel sweetened by oxidation, as measured by the JFTOT test, which comprises washing the sweetened jet fuel with aqueous caustic, washing the caustic-extracted jet fuel with water, and drying the water-washed jet fuel.

DETAILED DESCRIPTION OF THE INVENTION

Premium quality jet fuel is produced from selected kerosines low in total sulfur content. The process of the present invention is applicable to improving the stability to oxidation of any jet fuel which has been sweetened by oxidation. It is particularly applicable to fuels distilled from crude petroleum originating in China.

Figure 1:
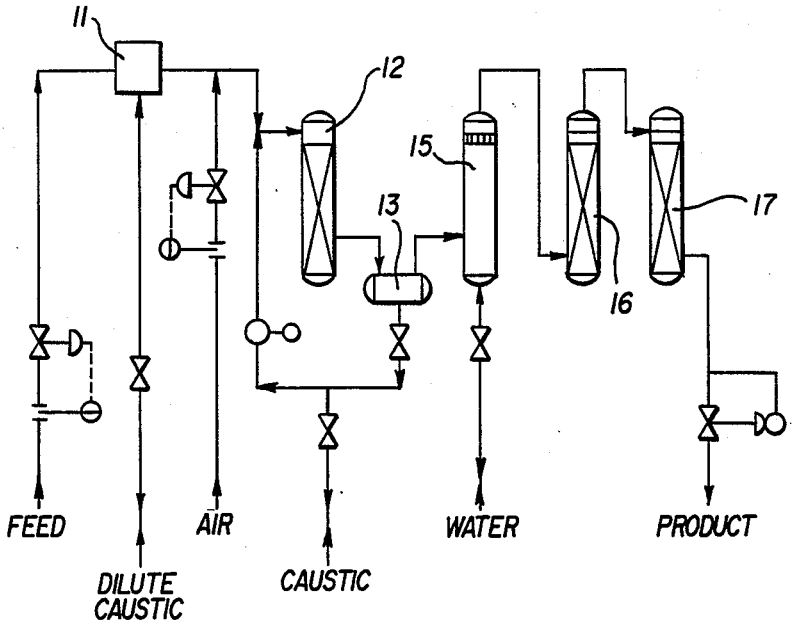
FIG. 1 is a flow sheet illustrating operation of a fixed-bed Merox sweetening process.

The operation of a typical fixed bed sweetening process for jet fuel is illustrated in FIG. 1. The feed is pre-treated by prewashing with caustic in prewasher 11 to remove naphthenic acids, which would react with sodium hydroxide in the reactor to form gelatinous solids. Air, the source of oxygen, in metered into the prewashed feed, which enters the top of reactor 12 and percolates downward through a body of Merox catalyst made alkaline with aqueous caustic. The sweetened product from reactor 12 is passed to settler 13 where caustic is separated for periodic recycle to the reactor. The sweetened fuel is washed with water in washer 15 to remove entrained caustic and other entrained water-soluble compounds. The traces of water present are removed by passage of the washed fuel through salt filter 16, and the dried fuel is freed of oil-soluble surfactants by passage through clay filter 17.

According to the process of the present invention, fuel sweetened by oxidation is stabilized by washing with an aqueous caustic solution. Any strong caustic, such as, but not limited to, potassium hydroxide, sodium hydroxide, and mixtures thereof, can be used. The concentration of the caustic in the solution should be between about 5 and 25 wt %, and preferably above 10 wt %. Caustic concentrations of about 15 wt % are particularly preferred. The aqueous solution containing the caustic may also contain a solubilizing agent, such as methanol, cresols, or the like. The concentration of caustic in the washing solution is controlled in a conventional manner to maintain the spent caustic at between about 30 to 50% spent.

Washing is accomplished in apparatus suitable for contacting two mutually immiscible liquids. However, aqueous systems containing caustic, when mixed with an oil phase, are prone to form emulsions. Thus, the washing apparatus utilized should be capable of contacting the aqueous and oil phases imparting only a minimum of mechanical energy to the system.

A fiber-film contactor is particularly suitable for washing an oil, such as jet fuel, with aqueous caustic. The aqueous caustic is passed to the top of the contactor and flows down a bundle of fibers in the contactor coating the fibers. At the same time, the jet fuel to be washed or prewashed with the aqueous caustic is also passed to the top of the contactor and flows down through the contactor contacting the aqueous caustic coating the fibers. The washed jet fuel and spent caustic, and under certain conditions a neutralized naphthenic acid phase, accumulate at the bottom of the contactor, without forming an emulsion, and are separated by conventional means.

After washing with caustic, the stabilized jet fuel is washed with water to remove any residual salt or caustic, and the washed fuel is dried using conventional procedures.

Figure 2:
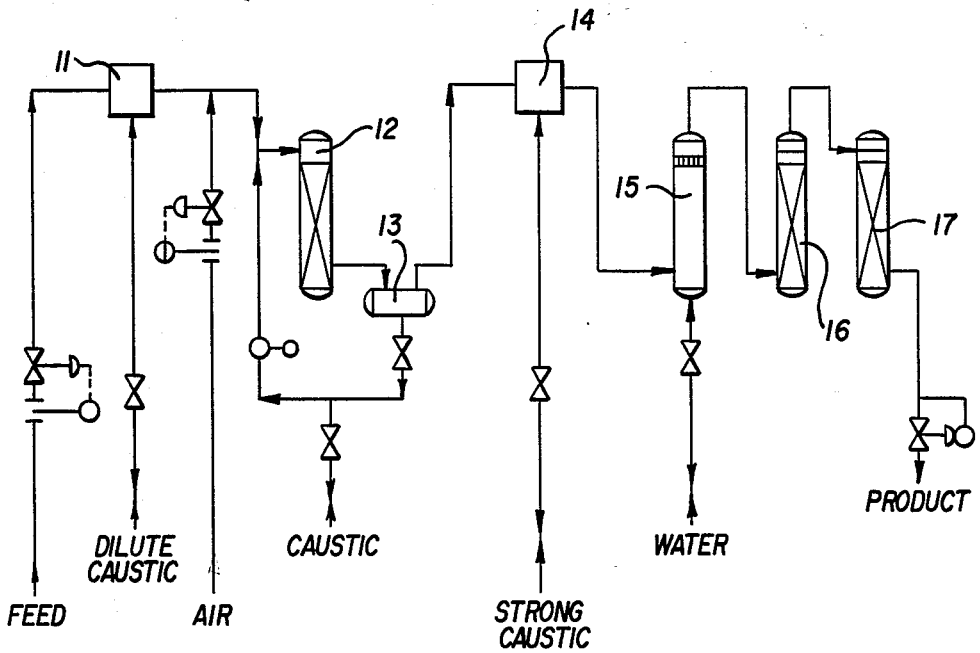
FIG. 2 is a flow sheet illustrating the process of the present invention integrated into the Merox-sweetening process shown in FIG. 1.

The process of the present invention may be utilized to stabilize fuel sweetened by oxidation at any convenient time or location. For example, it may be used to stabilize freshly sweetened jet fuels or jet fuels in storage terminals or at landing fields. In another embodiment, the overall procedure, sweetening of jet fuel by oxidation and improving thermal stability using the process of the persent invention, can be integrated. The operation of such an integrated process is illustrated in FIG. 2. As in the process illustrated in FIG. 1, the feed is prewashed with caustic in prewasher 11, sweetened in reactor 12, and passed to separator 13. The sweetened fuel is then washed with strong aqueous caustic in washer 14. The sweetened and stabilized jet fuel is washed with water in washer 15, and passed sequentially through salt filter 16 and clay filter 17.

The JFTOT thermal stability of jet fuel is evaluated by standard test method ASTM D-3241/82 for rating the tendencies of gas turbine fuels to deposit decomposition products. The test method subjects the fuel to to be tested to conditions which can be related to those occurring in a gas turbine engine fuel system. The fuel to be tested is pumped at a fixed flow rate through a heater after which it enters a precision stainless steel filter where fuel degradation products become trapped. The amount of deposition formed on the heater tube and the extent of plugging of the filter are measured.

Our invention is illustrated by means of the following non-limiting examples:

EXAMPLE 1

Merox sweetened Fuel-S was washed with 15 wt % aqueous sodium hydroxide, washed with water and then dried. Its thermal stability, as measured by the JFTOT test procedure, before and after washing with caustic, is shown in Table 1

TABLE 1

| | Merox Sweetened Fuel | Caustic Treated Merox Sweetened Fuel |
|---|---|---|
| Heater Tube Temp, °F. | 500 | 500 |
| Test Duration, Hrs. | 2.5 | 2.5 |
| Feed Flow Rate, ml/min. | 3.0 | 3.0 |
| Filter Press. Drop, inches of Hg. | 0.05 | 0.02 |
| Heater Tube Deposits | | |
| Visual Rating | 3-4 | 2 |
| After Spinning (Alcor Spun Tube Deposit Rating) | 19.0 | 2 |

EXAMPLE 2

The material extracted from the caustic-washed fuel in Example 1 comprised 0.036 wt % of the fuel and, on analysis, was found to contain the constituents listed in Table 2.

TABLE 2

| Constituent | Wt % |
|---|---|
| Acidic Compounds | 80.4 |
| Hydrocarbons | 5.4 |
| Basic Nitrogen Compounds | 3.1 |

The remaining constituents were not identified.

The thermal instability of Fuel-S can be attributed to the presence of the material extracted. This is evidenced by the fact that the addition of that material to samples of jet fuel decreased their thermal stability as measured in the JFTOT test procedure.

It is apparent from Table 2 that not all of the constituents in the material removed by the caustic washing of sweetened jet fuel are acidic. It should be noted that the jet fuel having its thermal stability to oxidation improved by the process of the present invention was prewashed with aqueous caustic prior to sweetening. And in processes for sweetening fuels by oxidation, such as in the Merox process, the jet fuel being sweetened also comes into intimate contact with aqueous caustic. Without limiting our invention to any theoretical mode of operation, it is apparent that the process of the present invention involves more than the extraction of acidic material from jet fuel by conventional procedures.

What is claimed is:

1. A process for improving JFTOT (Jet Fuel Thermal Oxidation Stability Test) thermal stability of jet fuel comprising washing the jet fuel with a dilute caustic wash, sweetening the jet fuel by oxidation of mercaptans to disulfides in the presence of a mercaptan oxidation catalyst comprising an iron-group metal chelate compound, then washing the jet fuel with strong aqueous caustic containing 10–25% by weight of caustic, and washing the caustic-washed jet fuel with water.

2. A process according to claim 1, wherein the aqueous caustic contains about 10–15% by weight of caustic.

3. A process according to claim 2, wherein the aqueous caustic contains about 15% by weight of caustic.

4. A process according to claim 1, wherein the aqueous caustic is sodium or potassium hydroxide.

5. A process according to claim 4, wherein the aqueous caustic contains about 15% by weight of sodium or potassium hydroxide.

* * * * *